US010045597B2

(12) United States Patent
Caruth

(10) Patent No.: US 10,045,597 B2
(45) **Date of Patent: *Aug. 14, 2018**

(54) MEDICATION CARRYING CASE

(71) Applicant: Debbie Joanne Caruth, Elmont, NY (US)

(72) Inventor: Debbie Joanne Caruth, Elmont, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/741,514

(22) Filed: Jan. 15, 2013

(65) Prior Publication Data

US 2013/0233741 A1 Sep. 12, 2013

Related U.S. Application Data

(60) Provisional application No. 61/607,346, filed on Mar. 6, 2012, provisional application No. 61/607,824, filed (Continued)

(51) Int. Cl.
*A45C 7/00* (2006.01)
*A61J 7/00* (2006.01)

(Continued)

(52) U.S. Cl.
CPC ..... *A45C 7/0027* (2013.01); *A45C 5/005* (2013.01); *A45C 7/005* (2013.01); *A45C 7/0054* (2013.01);

(Continued)

(58) Field of Classification Search
CPC ..... B65D 81/18; B65D 33/00; A61J 1/165; F25D 2331/8014; A61M 5/003; Y10S 206/828; A45C 9/00

(Continued)

(56) References Cited

U.S. PATENT DOCUMENTS 1,464,176 A * 8/1923 Freund ..... A45C 3/06 132/286
2,807,265 A 9/1957 Oliva et al.

(Continued)

OTHER PUBLICATIONS

Dec. 18, 2014 Non-Final Office Action for U.S. Appl. No. 13/741,521.
May 22, 2015 Final Office Action for U.S. Appl. No. 13/741,521.

*Primary Examiner* — Anthony Stashick
*Assistant Examiner* — James M Van Buskirk
(74) *Attorney, Agent, or Firm* — Daniel Baidwin; Global Intellectual Property Agency, LLC.

(57) ABSTRACT

Disclosed is a medication carrying case having a modular interior and a deployable tray work surface. The case structure is provided in several different sizes and designs, whereby medication and other articles are supported by removably attached organizational leaflets attached along the interior surfaces of the case. Each leaflet comprises a number of different pouches or organizational elements for supporting medication and accessory items. The deployable tray attaches along the exterior of the case and provides a clean work surface for organizing and preparing medication prior to use. For temperature sensitive medication, a cooling chamber is provided within the leaflet and behind a pouch to cool the pouch contents. Furthermore, an internal temperature sensing means and a timer element is provided to monitor the interior environment of the case and provide a means of notification for the user for administration of medication, respectively.

18 Claims, 7 Drawing Sheets

Related U.S. Application Data on Mar. 7, 2012, provisional application No. 61/696,632, filed on Sep. 4, 2012.

(51) Int. Cl.

| | |
|---|---|
| ***A61J 7/04*** | (2006.01) |
| ***A45C 5/00*** | (2006.01) |
| ***A45C 13/00*** | (2006.01) |
| ***A45C 15/00*** | (2006.01) |
| *F25D 3/08* | (2006.01) |
| *A45C 11/00* | (2006.01) |
| *A45C 13/02* | (2006.01) |

(52) U.S. Cl.

CPC ..... *A45C 13/008* (2013.01); *A45C 15/00* (2013.01); *A61J 7/0069* (2013.01); *A61J 7/0084* (2013.01); *A61J 7/0481* (2013.01); *A45C 2011/007* (2013.01); *A45C 2013/026* (2013.01); *A61J 2200/72* (2013.01); *F25D 3/08* (2013.01); *F25D 2303/0821* (2013.01); *F25D 2331/8014* (2013.01)

(58) Field of Classification Search

USPC ..... 206/232, 474; D3/203.8; 150/112, 113, 150/123; 224/654; 281/29–37

See application file for complete search history.

(56) References Cited

U.S. PATENT DOCUMENTS

| | | | | |
|---|---|---|---|---|
| 4,343,158 | A | | 8/1982 | Campbell |
| 4,429,793 | A | | 2/1984 | Ehmann |
| 5,012,931 | A | | 5/1991 | Ferrera |
| 5,114,259 | A | * | 5/1992 | Meservy et al. ..... 402/80 R |
| 5,118,213 | A | * | 6/1992 | Meservy et al. ..... 402/80 R |
| 5,226,532 | A | | 7/1993 | Davidson et al. |
| D338,781 | S | | 8/1993 | Eitel |
| 5,232,301 | A | | 8/1993 | Bianco |
| 5,598,923 | A | | 2/1997 | Owens |
| 5,610,770 | A | | 3/1997 | Galiani |
| D383,306 | S | | 9/1997 | Pennoyer |
| 5,865,314 | A | * | 2/1999 | Jacober ..... 206/570 |
| 5,911,441 | A | | 6/1999 | Yamamoto et al. |
| 5,931,303 | A | | 8/1999 | Salvadori |
| 5,956,968 | A | * | 9/1999 | Grabowski ..... A61J 1/165 220/500 |
| 6,095,564 | A | | 8/2000 | Wien |
| 6,109,442 | A | | 8/2000 | Roegner |
| 6,249,390 | B1 | | 6/2001 | Thibodeaux, Jr. |
| 6,253,570 | B1 | | 7/2001 | Lustig |
| 6,454,097 | B1 | | 9/2002 | Blanco |
| 6,491,074 | B1 | * | 12/2002 | Roegner ..... 150/112 |
| D505,543 | S | | 5/2005 | Miller |
| 6,935,133 | B2 | | 8/2005 | Keeter et al. |
| 6,959,814 | B1 | | 9/2005 | Hyman |
| D562,547 | S | | 2/2008 | Mesalic et al. |
| 7,565,979 | B1 | | 7/2009 | Gibson |
| D619,801 | S | | 7/2010 | Ma et al. |
| 8,006,846 | B2 | | 8/2011 | Robertson |
| 2003/0211617 | A1 | * | 11/2003 | Jones ..... 436/14 |
| 2006/0006097 | A1 | | 1/2006 | Peacock |
| 2008/0141700 | A1 | | 6/2008 | Fuchs |
| 2009/0107876 | A1 | | 4/2009 | Bengtson |
| 2010/0133139 | A1 | | 6/2010 | Lowe |
| 2011/0097017 | A1 | | 4/2011 | Abrams |
| 2012/0261041 | A1 | * | 10/2012 | Melamed ..... A45C 1/024 150/113 |

* cited by examiner

MEDICATION CARRYING CASE

CROSS REFERENCE TO RELATED APPLICATION

This application claims the benefit of U.S. Provisional Application No. 61/607,346 filed on Mar. 6, 2012, entitled "Diabetic-Kit," U.S. Provisional Application No. 61/607,824 filed on Mar. 7, 2012, entitled "Med-Kit," and U.S. Provisional Application No. 61/696,632 filed on Sep. 4, 2012, entitled "Med-Kit." The above identified patent applications are herein incorporated by reference in its entirety to provide continuity of disclosure.

BACKGROUND OF THE INVENTION

Field of the Invention

The present invention relates to a carrying case for transporting and adequately housing medical supplies while traveling. More specifically, the present invention pertains to a carry case or binder having a modular interior to hold medication for a user and to preserve temperature sensitive medication while traveling.

Many individuals require regular doses of medication to maintain their health, particularly those with diagnosed health conditions or illnesses. Specific dosages of certain medication may be required throughout the day, either because of a precipitating event or based on a prescribed interval. Organizing, storing and efficiently carrying medication can be a cumbersome task requiring diligence from the individual. Self-administered medication requires a careful eye for correct dosages, requires taking proper measures to adequately store the medication, and further requires the user to take the medication on the correct schedule and thus have it handy on the go if necessary. If patients are unable to take their required medication on a regular schedule or during an emergency event, the patient may be opening themselves up to greater health risks and even life threatening conditions. Further still, those patients that are not consistent with their medication can cause problems for healthcare providers when assessing the patient's proper needs and progress with a given medication type.

The first issue is transporting medication. For those patients requiring administration of medication throughout the day, a means of storing, organizing and efficiently traveling with the required medication is critical to ensure the medication is available when necessary and taken on schedule. The medication should be stored in readily recognizable containers and separated from one another, if more than one type is necessary for the user. Further, the medication should be properly stored and maintained. For medications such as insulin for diabetics, the insulin needs to be cooled to a specific temperature for storage. Maintaining a proper environment for the insulin is necessary to prevent its spoilage, which can leave a user stranded without a remedy while on the go.

A second issue is the organization and ability to administer the medication while on the go. Most carrying cases do not lend themselves well to providing a workspace for which to organize necessary items or medications, or further for providing proper separation of the medication. A further problem associated with most carrying cases and medical carriers is the adequacy of storing chilled medications such as insulin. Many medication carriers address needs of storage and provide a carry-all for medication, but there exists a need in the art for providing a single medication carrier that provides a workspace, efficient storage of medication, separation of all medication into readily identifiable compartments, and a means of storing climate sensitive medications over a period of time (insulin, etc.).

The present invention comprises a medication and insulin carrying case that provides adequate and efficient storage for its medical contents. The device comprises several embodiments for its design; however the case utility involves an internal insulin cooling means with a temperature monitor, a timer means for notifying a user of storage times and medication administering time intervals, a readily deployable work space for sorting medication, as well as an internal configuration that includes a variety of storage locations for supporting, separating and providing for ready identification of the different medications therein. The device is provided in different sizes and case configurations for the user to easily carry all necessary medication while on the go and deploy the medication when necessary in a given environment or over the course of a day.

Description of the Prior Art

Devices have been disclosed in the prior art that relate to medication cases and storage means. These include devices that have been patented and published in patent application publications, and generally relate to medicine container carrying cases and insulin carrying cases. While many cases are known in the art for carrying items, and in particular medication items, the present invention provides several key improvements that sufficient distinguish the present invention from those items in the prior art, while fulfilling a need for an efficient and useful medication carrying case device for users. The following is a list of devices deemed most relevant to the present disclosure, which are herein described for the purposes of highlighting and differentiating the unique aspects of the present invention, and further highlighting the drawbacks existing in the prior art.

Devices in the art include those that are binder-style device having single fold and two opposing faces forming an interior pouch or caddy that is sealable. Within the caddy is a plurality of pockets or medical container organization elements that allow a user to quickly locate a given medication. Included in these binder-style medical caddies are those kits that support insulin syringes and blood testing tools. U.S. Pat. No. 6,959,814 to Hyman discloses a flexible case having a clear plastic pocket within the case, a receptacle, an insulin source, pockets for disinfectant pads and an open strap to secure a syringe therein. U.S. Pat. No. 4,429,793 to Ehmann discloses a similar device but for pocket-sized carrying purposes. U.S. Patent Application Publication No. 2008/0141700 to Fuchs discloses yet another single-fold binder for medical supplies and accessories, wherein a cold pack is situated therein for preserving insulin. Finally, U.S. Pat. No. 7,565,979 to Gibson discloses a medicinal binder that includes a pill case, a plurality of medicine container loops and a calendar positioned on the interior of the case, while U.S. Pat. No. 6,935,133 to Keeter discloses a temperature controlled, insulated medicinal binder.

The medical kits and binders of the prior art fail to address the need for an adequate workspace when accessing the case contents. These devices similarly provide no means to monitor the internal temperature of the case in the case of carrying cooled insulin. Finally, these devices provide no timer element to notify a user that a medication administration interval has lapsed or if the internal temperature has dropped below an acceptable level for insulin storage. The present invention fulfills these needs by disclosing a new and novel medicinal carrying case for general medicine and refrigerated medicine such as insulin. The present invention provides a carrying case, kit or carry-all that is provided in a number of different designs and styles, where the aforementioned functions are provided for the user while traveling with medication and treatments.

Further articles in the prior art relate to larger carrying cases for medication and medical accessories. Specifically, U.S. Pat. No. 6,253,570 to Lustig discloses a traveling bag for carrying temperature-sensitive medications including a compartment for containing freezing material for insulin. An external temperature gauge provides a user with knowledge of the case's internal temperature to prevent the insulin from spoiling. U.S. Pat. No. 8,006,846 to Robertson discloses another portable carrying case that includes an interior and a securable lid, wherein a vial platform having spaced divider walls and a central cord lock allows vials of medical products or compounds to be securely transported. Finally, U.S. Pat. No. 6,454,097 to Blanco discloses a prioritized first aid kit that comprises an interior having a plurality of compartments that are each identified by clear indicia. The order or severity of the treatment is prioritized therein to allow first responders quick access.

The larger carrying cases relate to briefcase style supports for medicine and first aid equipment. Similar to the single-fold medicine carriers, these larger devices do not anticipate the features of the present invention. While providing increased carrying capacity and elements within the container that allow for general medical supplies and more specialized medicine such as insulin, the devices fail to disclose an adequate working space and interval timer for notifying the user of administration intervals and when monitoring the length of time an insulin vial has been in the carrying case.

The present invention provides a medication carrying case and binder that provides several functional elements, including a deployable work surface that allows for organization and administration of medicine and supplies. Further elements include an internal temperature sensing means and a timer clock for setting reminders of events and tracking time intervals. The design of the present invention is disclosed having several embodiments, allowing for a compact case with efficient carrying of medical supplies, as well as larger, more accommodating carrying cases for greater amounts of needed medical supplies while traveling. It is submitted that the present invention is substantially diverges in design elements from the prior art, and consequently it is clear that there is a need in the art for an improvement to existing medical carrying case devices. In this regard the instant invention substantially fulfills these needs.

SUMMARY OF THE INVENTION

In view of the foregoing disadvantages inherent in the known types of medical carrying cases now present in the prior art, the present invention provides a new and improved carrying case that can be utilized for providing convenience for the user when carrying medication and insulin within a chilled case and for deploying medication from the case while traveling.

It is therefore an object of the present invention to provide a new and improved medical carrying case device that has all of the advantages of the prior art and none of the disadvantages.

It is another object of the present invention to provide a medical carrying case device that comprises a number of different sizes and designs for the purposes of providing efficient storage of medicine and medical supplies while traveling.

Another object of the present invention is to provide a medical carrying case device that includes a cooling means and a temperature monitoring means for carrying insulin for diabetic users.

Yet another object of the present invention is to provide a medical carrying case device that includes a timer means for alerting the user of medication intake intervals and notifying the user of how long a cooled article has been in the case while traveling.

Still yet another object of the present invention is to provide a medical carrying case device that includes a deployable tray that allows a user to deploy, sort and visualize medication on a clean support surface prior to administration of the medication.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
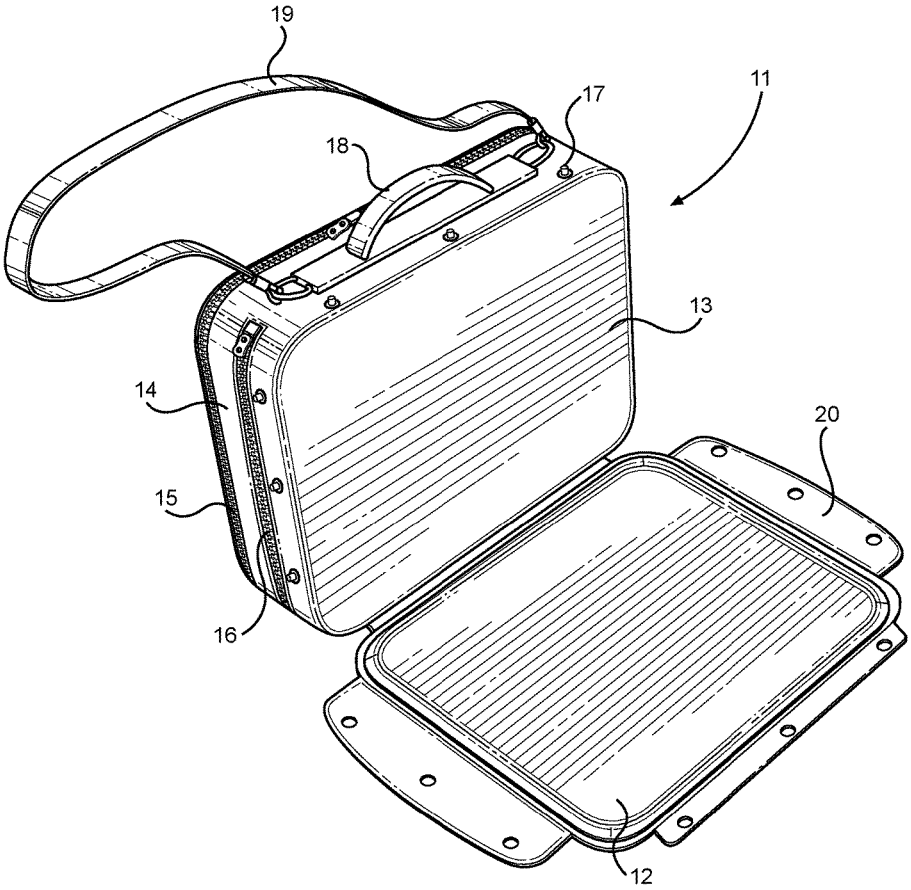
FIG. 1 shows a perspective view of the present invention and the deployable tray in a working position.

Reference is made herein to the attached drawings. Like reference numerals are used throughout the drawings to depict like or similar elements of the medical carrying case. For the purposes of presenting a brief and clear description of the present invention, the preferred embodiment will be discussed as used for carrying insulin and medication while traveling. The figures are intended for representative purposes only and should not be considered to be limiting in any respect.

Referring now to FIG. 1, there is shown a perspective view of an embodiment of the present invention. The device comprises a medical carrying case having a deployable medical tray 12, internal storage adapted to organize medication and medical supplies, and a means for supporting temperature sensitive articles. The device comprises an article of luggage or carry-all having an interior volume secured closed by a zippered securement means 16 along the perimeter of at least two flaps forming the case structure, wherein FIG. 1 the flaps comprise two standard suitcase ends forming a base 14 and a lid opening 13. Several designs for the case are contemplates. In FIG. 1, a briefcase style embodiment is shown, comprising a single fold and a single zipper opening 16 around the perimeter of the case lid 13. A second zipper 15 provides for an expansion chamber that extends the base 14 of the case for increased carrying capacity. When the lid 13 is closed, a deployable and optionally detachable medication tray 12 secures over the lid 13 via a plurality of attachment flaps 20 such that the tray is coextensive with the lid. The tray 12 is deployable from its connection to the case, whereby the tray provides an inner surface adapted to provide a clean working surface to support medication and medical supplies thereon. The tray outer surface comprises the same material as the exterior surfaces of the case, such that the exterior surface of the case is uniform and resistant to damage or wear. Along the upper portion of the case is further provided a carrying handle 18 and a shoulder strap for carrying the case and its contents over a distance.

The tray 12 is deployable from the surface of the case opposite the lid 13, whereby the lid 13 opens towards the inner surface of the tray for withdrawing medication and supplies directly thereonto. When stowed, the tray 12 is placed against the lid 13 and secured thereto using a plurality of securement snaps 17 that affix a plurality of attachment flaps 20 of the tray thereto. The attachment flaps are elastic members that extend outward from the perimeter of the tray 12 along at least one side. Corresponding securement snaps 17 positioned about the lid 13 perimeter prevent the tray from inadvertently deploying when the user is transporting the case. The tray 12 therefore remains attached to the case 11 along its lower edge when deployed, or alternatively the tray 12 may be completely removed therefrom to provide an independent medication tray for the user. This lower edge connection may also comprise snap securement elements in the same fashion as the other tray flap connectors 17.

Figure 2:
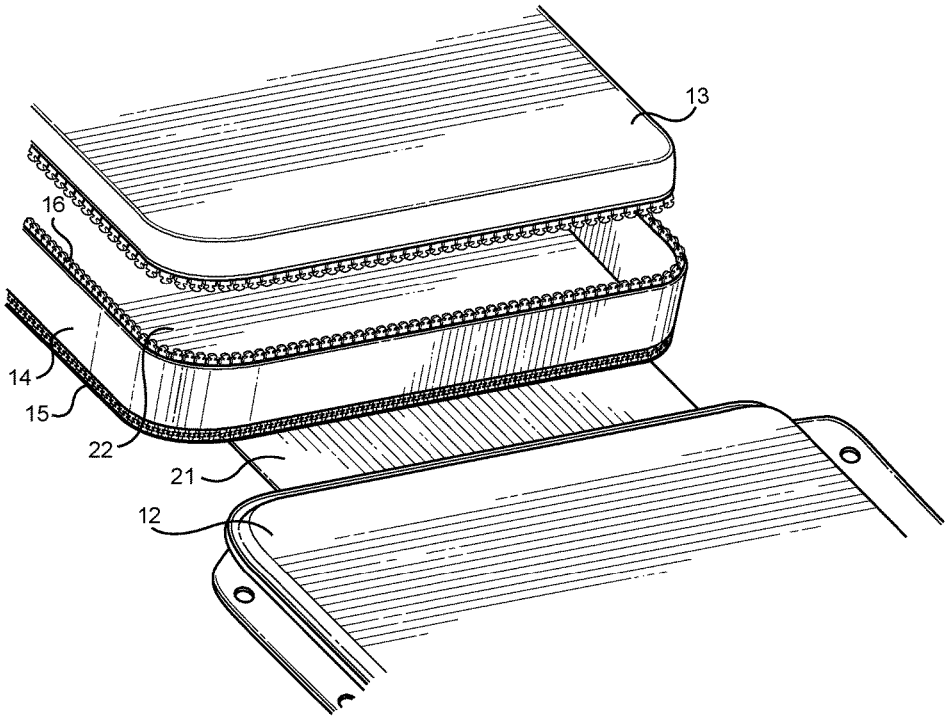
FIG. 2 shows the deployable tray connection with the case.

Referring now to FIG. 2, there is shown a view of the present medication tray 12 in a deployed state and attached to the case. In this position, the case contents can be accessed and placed directly on the tray for inspection. The lid flap 13 is pivotable the base flap 14 along its peripheral edge once its zippered connection 16 is opened, while the tray 12 may be pivoted from its connection with either the base or the lid. The tray connector 21 and its location relative to the lid 13 is shown in one configuration in FIG. 2, whereby the flap 21 does not interfere with the operation of the lid 13. Since the tray has the ability to be completely removable from the case, it can be pivoted outward from any one of its attachment flaps to provide flexibility for the user when accessing the case interior and using the tray for its intended purpose. In any deployed state, access to the case interior 22 is necessary and therefore access to the lid zipper closure 16 is required. The interior 22 of the case houses the medication and supplies for which the user requires, therefore unencumbered access is required. The volume of the case can also be expanded 15 as necessary and its interior can be modified to accommodate a number of different medication and medical supplies types, as desired by the user and its application.

Figure 3:
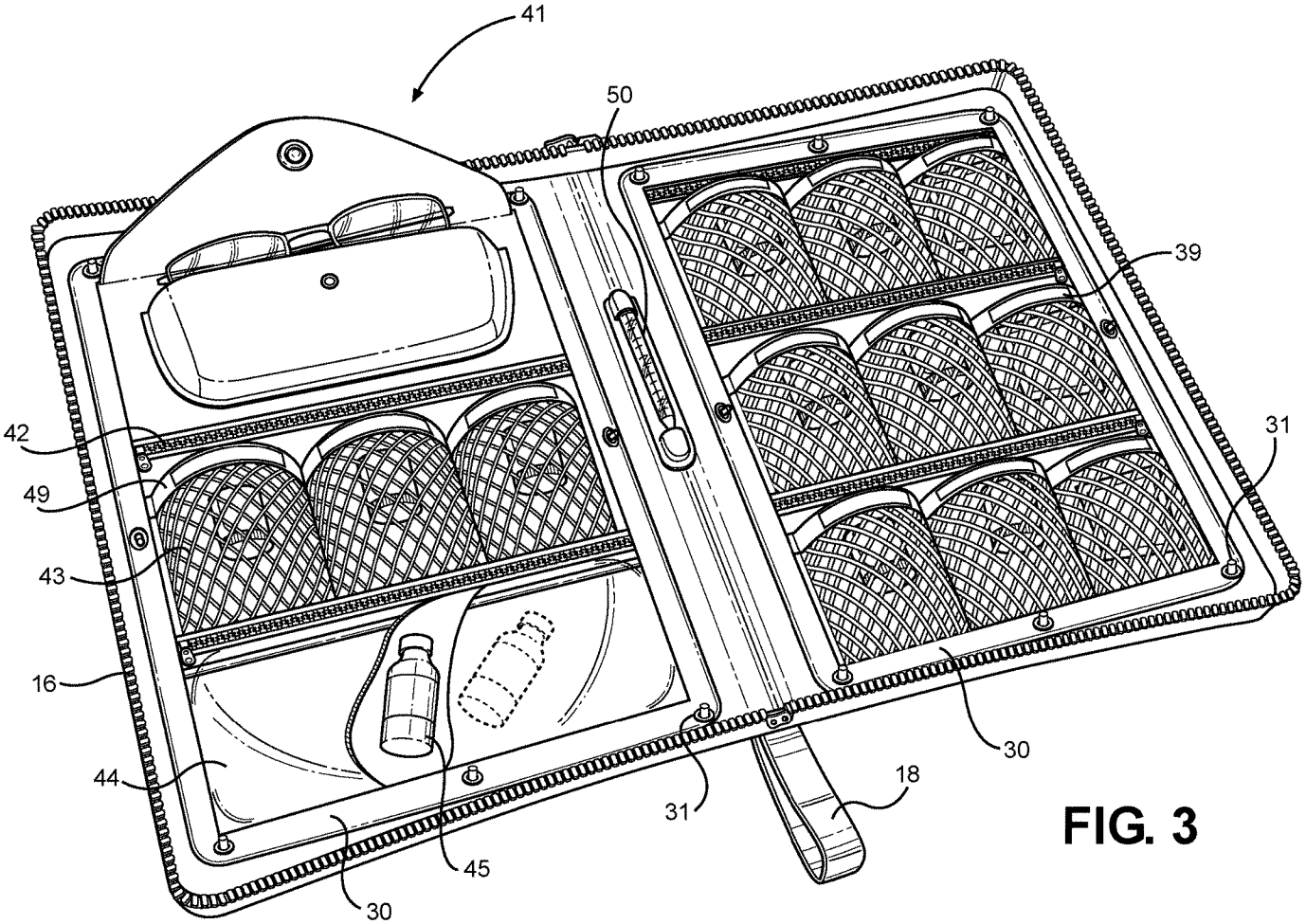
FIG. 3 shows a binder style embodiment of the present invention.

Turning to FIG. 3, there is shown a view of the binder embodiment of the present invention and an internal view of the organizational elements utilized to secure items within the case interior. The carrying case of the present invention contemplates several different design variations depending on end user needs and the desired carrying capacity of the structure. The internal elements of the case include a plurality of features for efficiently organizing medication and medical accessories, whereby a user is capable of rapidly locating and accessing the items from within the case. At least one removable leaflet 30 is provided within the case interior that attaches to the inner walls of the case, whereby a leaflet comprises a number of different pouches, pockets and securement means for different medication and accessory items. Overall, it is desired to disclose a carrying case that utilizes removable interior leaflets that efficiently organize medical products for a user while traveling. The elements of the case structure are well known; however the use of interior leaflets and the presence of a deployable tray work surface directs the case to a medication storage and transport application.

In a one embodiment, the interior leaflets comprise a plurality of accessible pouches 43 having an open upper 49 for accessing each pouch and for placing items therein, while a backside pocket 48 with a zipper closure 42 behind the pouch provides a means of placing a cooling pack behind the pouch 43 for cooling the pouch contents. The ability to place cooling packs directly behind a pouch allows for carrying temperature-sensitive products such as insulin, and preserving their contents over a period. Each of the pouches 43 comprises an elastic mesh or elastic material 44 for efficiently retaining items therein while promoting visualization of the items. This allows items to be secured without requiring the user to inspect each pouch individually when accessing the items. Along each of the pockets is a built-in label holder for labeling and easily identifying different medication if the user wishes to label specific pockets. Each leaflet 30 secures to the inner walls of the carrying case using an eyelet and hook system 31 or suitable alternative that allows the leaflets to be removable securable. Therefore the leaflets 30 can be readily removed or swapped for different interior configurations, whereby the user is not required to purchase different cases to tailor the case for a specific medication or a specific trip. Some leaflets may comprise a plurality of aligned pouches 43, whereby the pouches may be of different sizes, while other leaflets may comprise different accessory holders 41 or backside cooling pouches 48 for cooling articles within the pouches. The backside pouches 48 are preferably lined with water resistant material to prevent condensation from exiting, while the opening of the cooling pouches is preferably secured by a zip fastener closure means 42.

Provided within the carrying case is a temperature sensing means 50 that notifies the user of the internal temperature within the case such that he or she may monitor the case contents against a minimum threshold. Temperature monitoring is critical for carrying temperature sensitive products such as insulin, which may spoil if left unrefrigerated for a period of time. In a preferred embodiment, an internal thermometer 50 is provided, which may be positioned along the binding of the case or may be provided along the exterior of a cooled pouch to provide more direct temperature measurements. The thermometer 50 may further be removed and placed into a cooled pouch 44 where insulin 45 is stored, whereafter the user can access the cooled pouch 44 and read the thermometer to determine if the insulin is still suitable for use.

Figure 4:
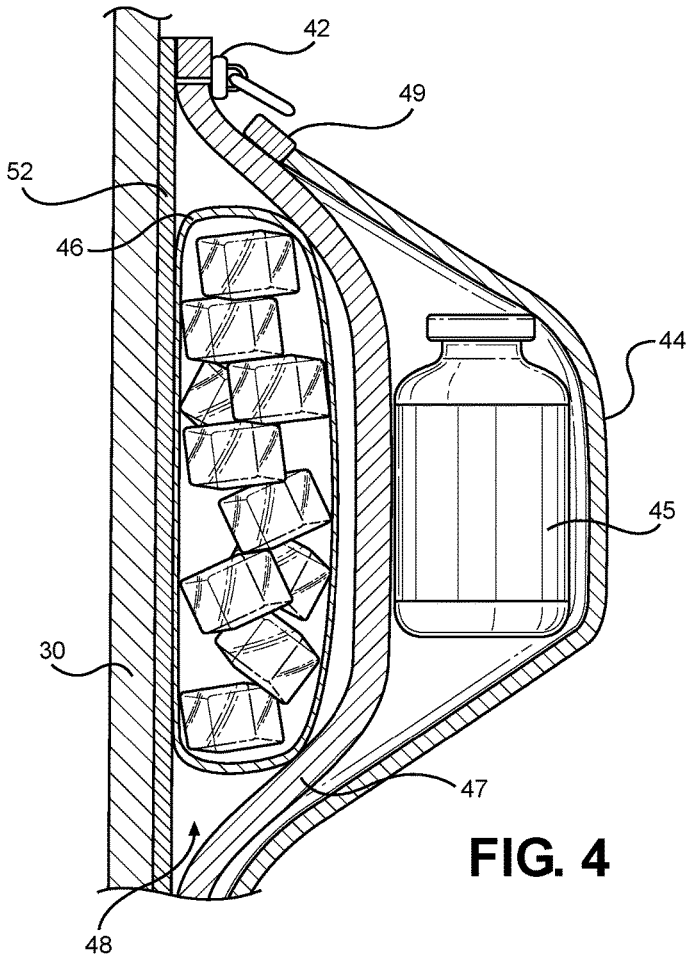
FIG. 4 shows a cross section view of a cooling pack in conjunction with a leaflet holding insulin.

Referring now to FIG. 4, there is shown a cross section view of a leaflet pouch. In this view, there is show the leaflet surface 30, the backside pouch 48 containing the cooling means 46, the outer pouch 44 for securing the cooled item 45 therein and the means by which to access both the backside pouch 48 and the outer pouch. This arrangement allows a user to place an ice cube pack 46 or chemical ice pack directly behind the pouch 44 holding the item 45. Medication such as insulin requires a controlled climate to prevent spoilage. If a diabetic user is traveling, this leaflet arrangement allows the user to cool the insulin 45 over a period of time within the interior of the case. The cooling means 46 is contained within the backside pouch 48, whereby condensation from the pack is contained within water resistant walls 52, 47 of the pouch to prevent moisture from entering into the case interior. To access the backside pouch, a zipper closure 42 allows the user to place or remove the cooling means 46, while the medication 45 may be placed within the outer pouch 44 through its upper opening 49. The upper opening 49 and the outer pouch 44 is preferably an elastic material that conforms to the medication item 45 to prevent movement while in transit.

Figure 5:
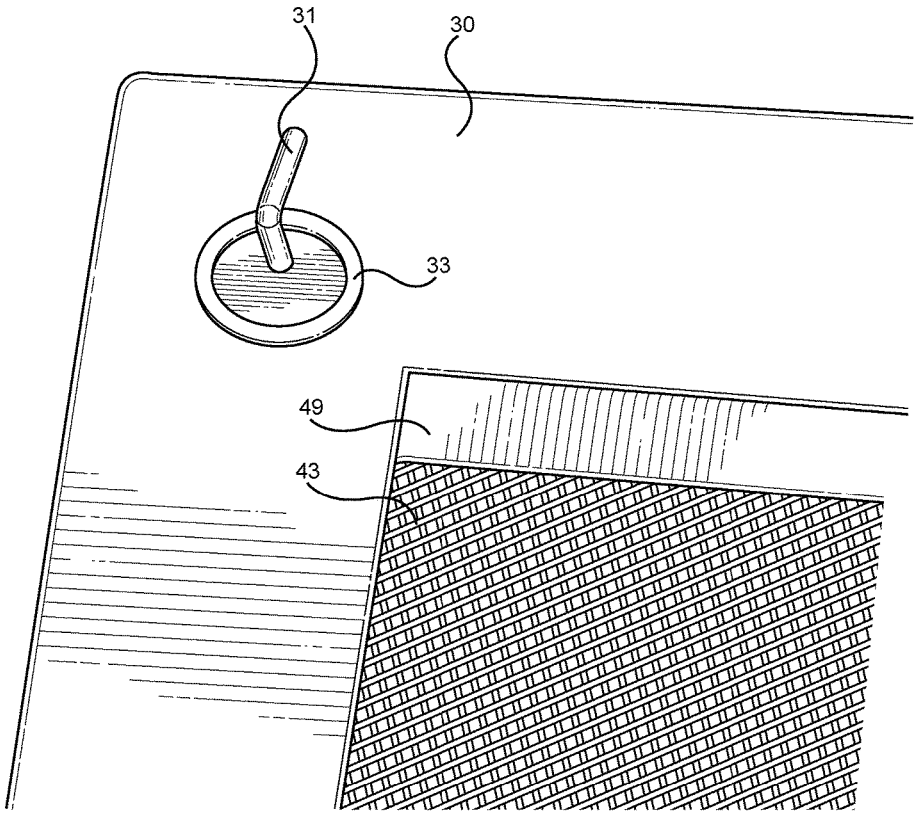
FIG. 5 shows a connector element for an internal leaflet.

Referring now to FIG. 5, there is shown a close-up view of the leaflet securement means within the interior of the case. The leaflets 30 are organizational structures that support items within the case. These articles are designed to be removable from the case to provide a modular carrying structure of different medication and different types of transport needs. The leaflets 30 secure to the interior surfaces of the case using an L-bracket 31 or hook and eyelet 33, whereby each corner of the leaflet is secured thereby to prevent relative movement between the leaflet 30 and the case interior surface. This also allows a user to access the interior pouches 43 and expand each pouch opening 49 without the leaflets pulling away from the case interior surface during use. As an alternative, the leaflets may be secured to the case interior using a number of different securement means, including hook and loop fasteners, snaps or other suitable means. Overall, it is desired that present invention provides modular and efficient means of storing and transporting medication while the user it on the go.

Figure 6:
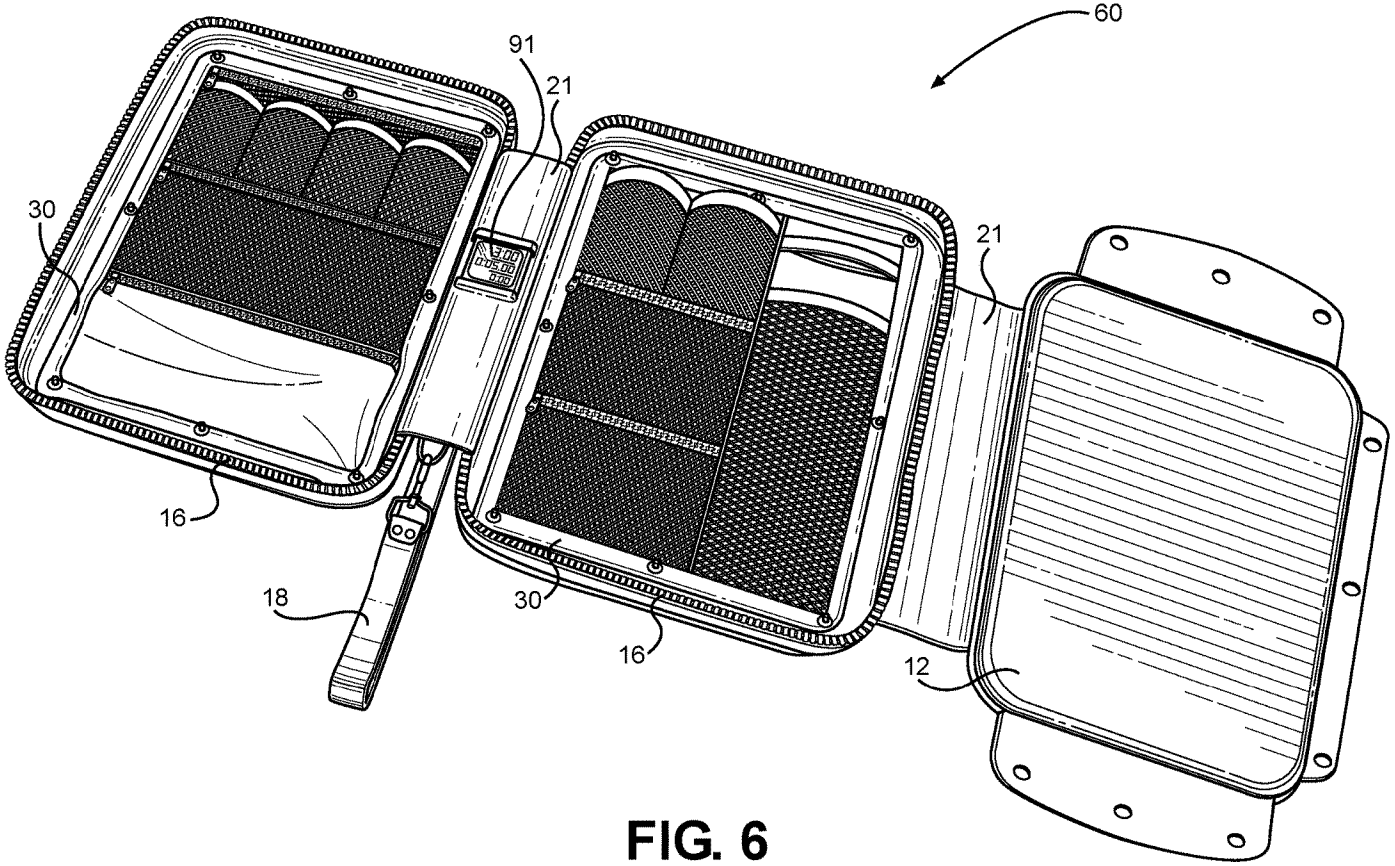
FIG. 6 shows a mid-size embodiment of the medical carrying case.
Figure 7:
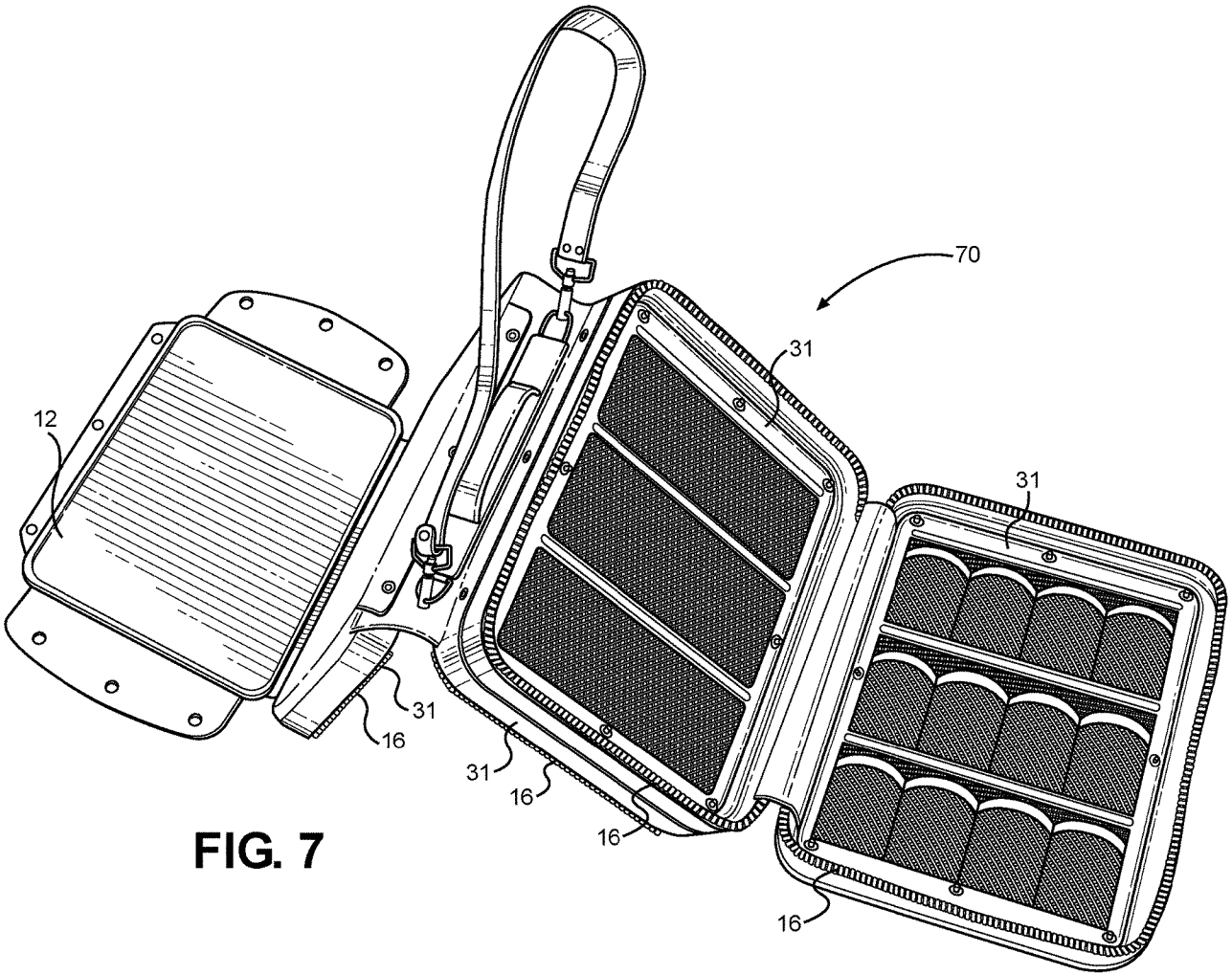
FIG. 7 shows a Z-shaped embodiment of the medical carrying case.

Referring now to FIGS. 6 and 7, there are shown a first 60 and second 70 design for the present case, whereby the interior volume of the case and its structure incorporates different arrangements and sizes for the purposes of supporting the internal leaflets 30. Each embodiment includes modular leaflets and a deployable tray 12, while the number of leaflets and the overall size of the case may vary between designs. Larger embodiments of the case comprise several compartments that connect 21 to one another, establishing a single fold, two fold or multiple-fold structure having aligned and accessible compartments. Each compartment 31 is includes a pair of opposed interior surfaces 31 supporting the leaflets 30, whereby the compartments are individually accessed via a zipper closure 16 along a line of connection between surfaces 31. The design of the interior leaflets also be a design consideration, where the arrangement of pockets and each pocket may include unique qualities for securing items within the case.

Another feature of the present invention is an interval timer 91 element that may be incorporated into the structure of the case. This timer 91 may supplant the temperature sensing means as a way to determine whether a sensitive medication is still viable or if the cooling means needs replacement. The timer 91 may also function as a medication interval timer such that the timer 91 provides an audible alert for the user when to take a dose of a medication. This is important for elderly users traveling, who may forget to take regular doses of pills and other medication throughout the day. Toting an organized medication carrier with a dosage timer is convenient for those patients taking different medication on a regular basis while away from home.

Overall, the present invention provides a new and novel carrying case that efficiently organizes medication and medical supplies for individuals traveling outside of the home. The case simplifies a user's process of organizing and dispensing medication throughout the day, while also providing a means of supporting temperature sensitive medication therein. The structure of the case is at least two opposing case flaps that form the case structure, wherein organizational leaflets are provided along the interior surface of each leaflet and a deployable tray offers a work space for the user. The size of the case and its design elements may be tailored to a specific user's needs for different carrying capacities and styles of case. The primary purpose of the case, however, is to efficiently transport medication, allow quick access to the medication and preserve temperature sensitive medication while traveling.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A medication carrying case, comprising:

at least two opposing case flaps forming a structure having an interior volume wherein said flaps are joined by a zippered line of connection;

said opposing case flaps having an interior surface and an exterior surface, said exterior surface forming an outer surface of said case, said interior surface facing inward within said case structure interior volume;

an organizational leaflet having at least one medication pouch thereon being removably attached to at least one of said flap interior surfaces;

a deployable tray pivotably extending from a peripheral edge of the exterior surface of at least one case flap;

wherein the interior surface is entirely planar, void of obstruction so as to form a work surface when in a working position and configured to enclose the entire exterior surface of at least one case flap when in a closed position;

an attachment flap disposed along a peripheral edge of the deployable tray, the attachment flap configured to secure the deployable tray to the opposing case flap to which the deployable tray is connected;

wherein the attachment flap does not extend over the zippered line of connection when secured to the opposing case flap.

2. The device of claim 1, wherein said at least one leaflet comprises a planar structure, wherein said medication pouch comprises an elastic outer flap surface and an open upper to support articles therein.

3. The device of claim 1, wherein said at least one leaflet comprises a planar structure being removably attachable to said case interior surface, wherein said leaflet removable connection comprises an eyelet and hook attachment.

4. The device of claim 1, wherein:

said at least one leaflet comprises a planar structure;

at least one pouch having a backside pouch for housing a cooling means therein;

said backside pouch comprising a moisture sealed cavity coextensive and behind said medication pouch.

5. The device of claim 1, wherein:

at least one pouch having a backside pouch for housing a cooling means therein;

said backside pouch comprising a moisture sealed cavity coextensive and behind said medication pouch;

a temperature measuring means within said case interior to measure said interior volume temperature.

6. The device of claim 1, further comprising an interval timer means that can be set by a user and produce audible alerts.

7. The device of claim 1, further comprising an expansion zipper along an entire outer peripheral edge of one of said case flaps for expanding said interior volume.

8. The device of claim 1, wherein the deployable tray comprises an upper edge, a lower edge, and a pair of opposing lateral edges orthogonal to the upper and lower edges;

wherein the lower edge of the deployable tray is connected to the least one case flap;

wherein the attachment flap comprises a plurality of attachment flaps secured to each of the upper edge and the pair of opposing lateral edges of the deployable tray.

9. The device of claim 1, wherein the attachment flap comprises a plurality of apertures and the opposing case flap comprises a plurality of securement snaps configured to align with and removably secure within each plurality of apertures when in the closed position.

10. The device of claim 1, wherein each of the least two opposing case flaps comprise an upper edge, a lower edge, and a pair of opposing lateral edges orthogonal to the upper and lower edge, wherein the zippered line of connection is only disposed along the lower edge and the pair of opposing lateral edges of the least two opposing case flaps.

11. The device of claim 1, wherein the deployable tray is detachable from the at least one case flap, such that the deployable tray is not directly connected to the at least one case flap.

12. The device of claim 1, further comprising a tray connector disposed between the deployable tray and the at least one case flap, wherein a linear length of the tray connector is smaller than a linear length of each of the deployable tray and the at least one case flap.

13. A medication carrying case, comprising:

at least two opposing case flaps forming a structure having an interior volume wherein said flaps are joined by a zippered line of connection;

said opposing case flaps having an interior surface and an exterior surface, said exterior surface forming an outer surface of said case, said interior surface facing inward within said case structure interior volume;

a deployable tray pivotably extending from a peripheral edge of the exterior surface of at least one case flap;

wherein the interior surface is entirely planar, void of obstruction so as to form a work surface when in a working position and configured to enclose the entire exterior surface of at least one case flap when in a closed position;

an interior surface of the deployable tray configured to rest against the exterior surface of at least one case flap;

an attachment flap disposed along a peripheral edge of the deployable tray, the attachment flap configured to secure the deployable tray to the opposing case flap to which the deployable tray is connected;

wherein the attachment flap does not extend over the zippered line of connection when secured to the opposing case flap;

an organizational leaflet having at least one medication pouch thereon being removably attached to at least one of said flap interior surfaces; and an interval timer means that can be set by a user and produce audible alerts.

14. The device of claim 13, wherein said at least one leaflet comprises a planar structure, wherein said medication pouch comprises an elastic outer flap surface and an open upper to support articles therein.

15. The device of claim 13, wherein said at least one leaflet comprises a planar structure being removably attachable to said case interior surface, wherein said leaflet removable connection comprises an eyelet and hook attachment.

16. The device of claim 13, wherein:

said at least one leaflet comprises a planar structure;

at least one pouch having a backside pouch for housing a cooling means therein;

said backside pouch comprising a moisture sealed cavity coextensive and behind said medication pouch.

17. The device of claim 13, wherein:

at least one pouch having a backside pouch for housing a cooling means therein;

said backside pouch comprising a moisture sealed cavity coextensive and behind said medication pouch;

a temperature measuring means within said case interior to measure said interior volume temperature.

18. The device of claim 13, further comprising an expansion zipper along an entire outer peripheral edge of one of said case flaps for expanding said interior volume.

* * * * *